United States Patent [19]

Cheng

[11] Patent Number: 5,000,713

[45] Date of Patent: Mar. 19, 1991

[54] COMBINABLE TOY BLOCKS

[76] Inventor: Ming H. Cheng, No. 6, Lane 94, Te Chang St., Taipei, Taiwan

[21] Appl. No.: 397,181

[22] Filed: Aug. 23, 1989

[51] Int. Cl.[5] ..... A63H 33/08

[52] U.S. Cl. ..... 446/120; 446/128; 273/160

[58] Field of Search ..... 446/85, 117, 120, 121, 446/122, 123, 124, 125, 128; 273/156, 157 R, 160

[56] References Cited

U.S. PATENT DOCUMENTS

| | | | |
|---|---|---|---|
| 2,972,833 | 2/1961 | La Grutta | 446/121 |
| 3,374,917 | 3/1968 | Troy | 446/125 X |
| 3,496,670 | 2/1970 | Sloop et al. | 446/124 X |
| 3,670,449 | 6/1972 | Lemkin et al. | 446/125 X |
| 3,822,499 | 7/1974 | DeVos | 446/121 |
| 3,905,150 | 9/1975 | Dawn | 446/124 |
| 4,026,065 | 5/1977 | Dick | 446/121 |
| 4,106,657 | 8/1978 | Dogliotti | 446/121 X |
| 4,678,192 | 7/1987 | Campbell | 496/124 X |

*Primary Examiner*—Mickey Yu

*Attorney, Agent, or Firm*—Thomas S. Keaty; Keaty & Keaty

[57] ABSTRACT

Combinable toy blocks including at most two different type of units which both are cubic. A first unit has a protuberance formed on at least one surface thereof and a depression is formed on each respective remaining surface thereof. A second unit has the depression formed on each respective surface thereof. The depression is fittable to the protuberance. The units are joinable to be plurality of different pieces. Furthermore, the different pieces are joinable to be a square or a cube.

3 Claims, 8 Drawing Sheets

COMBINABLE TOY BLOCKS

BACKGROUND OF THE INVENTION

The present invention relates to combinable toy blocks, and more particularly to such combinable toy blocks which stimulate creative development.

In the past, building blocks served the purpose of entertainment but not education. Further, if each unit of the building blocks is not the same, then the entertainment value will be reduced if any unit is lost.

In order to mitigate and/or obviate the above-mentioned drawbacks in the manner set forth in the detailed description of the preferred embodiment, the present invention is to provide novelty combinable toy blocks.

SUMMARY OF THE INVENTION

The primary objective of the present invention is to provide combinable toy blocks comprising at most two different types of units.

Another objective of the present invention is to provide combinable toy blocks which stimulate creative development.

A further objective of the present invention is to provide combinable toy blocks which are joinable to form a square or a cube.

These and additional objectives, if not set forth specifically herein, will be readily apparent to those skilled in the art from the detailed description provided hereinbelow, with appropriate reference to the accompanying drawings.

DETAILED DESCRIPTION OF THE PREFERRED EMBODIMENT

Figure 1:
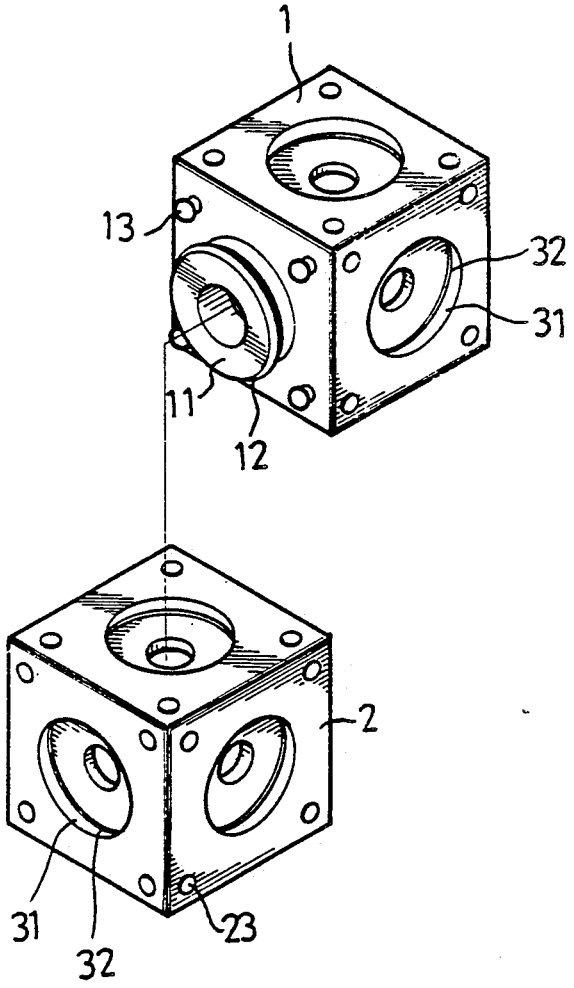
FIG. 1 is a perspective view of two different types of units of the combinable toy blocks in accordance with the present invention.
Figure 7:
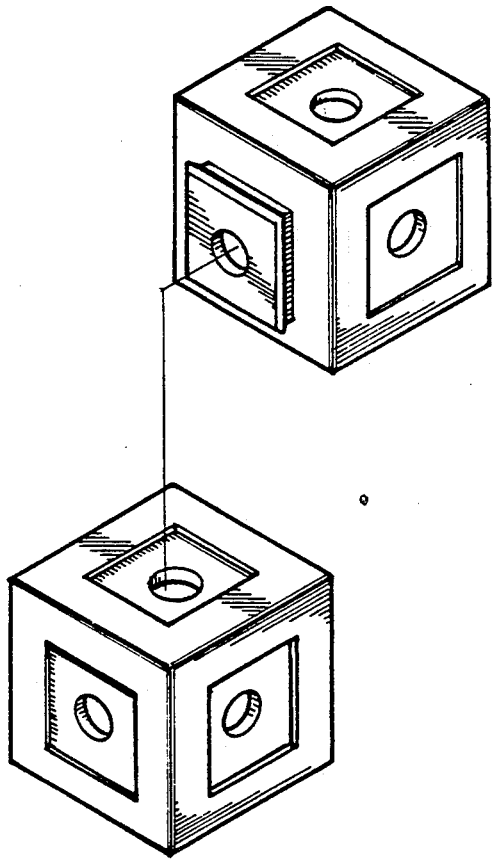
FIG. 7 is another embodiment of the present invention, showing a different shape for the units.

With reference to FIG. 1, the combinable toy blocks of the present invention substantially comprise at most two different types of units which are both cubic and made from resilient material. A first unit 1 has a protuberance 11 formed on at least one surface. In a preferred embodiment, the protuberance 11 can be formed as a disc and in another embodiment, it also can be formed as a square, as shown in FIG. 7. A depression 31 is formed on each respective remaining surface corresponding to the shape of the protuberance 11 such that the depression 31 is fittable with the protuberance 11. A second unit 2 has the depression 31 formed on each respective surface thereof.

Figure 2:
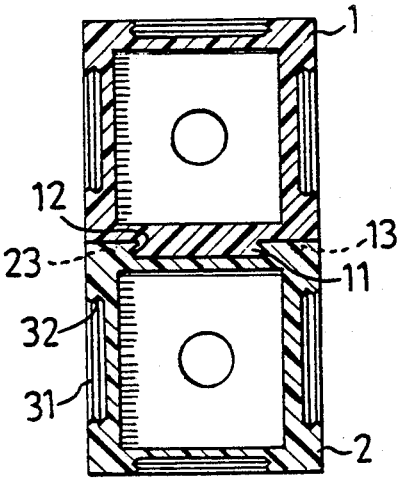
FIG. 2 is a cross-sectional view of the engagement of the two different types of units of FIG. 1.

Each protuberance 11 is formed with an enlarged peripheral flange 12. Each depression 31, then, has a slot 32 formed therein such as to securely engage the depression 31 with the protuberance 11, as shown in FIG. 2.

Each surface, on which the protuberance 11 is located, has a plurality of engaging bolts 13 integral therewith. Each remaining surface, on which the depression 31 is located, then, has a plurality of openings 23 which correspond to the engaging bolts 13, and are provided for receiving the engaging bolts 13. The individual units are, in the manner, connectable to form pieces which are, in turn, joinable to form a square or a cube.

Figure 3:
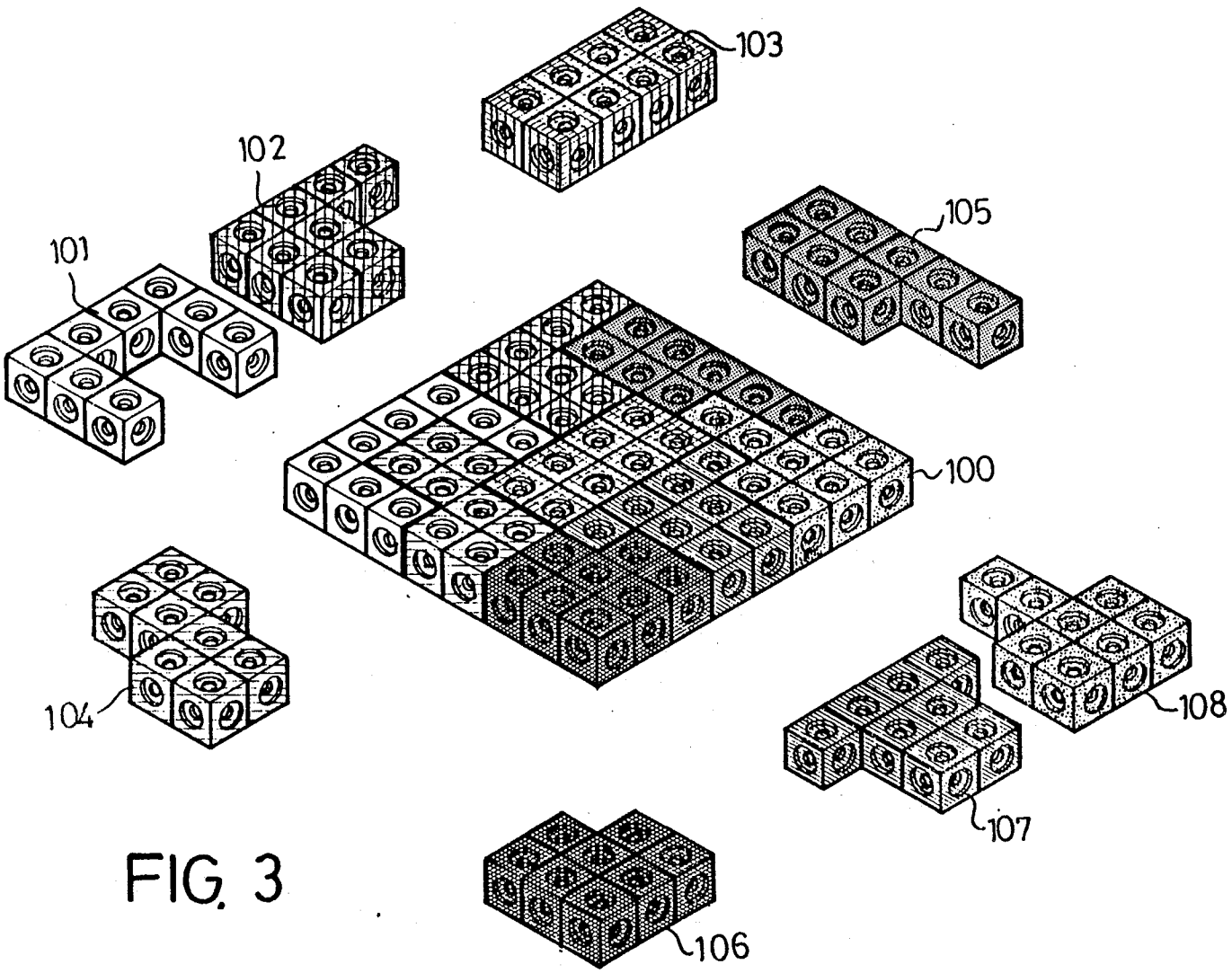
FIG. 3 is a perspective view showing eight pieces, each a combination of a number of two different types of units, joined together to form an 8×8 square (in the center)

A preferred embodiment as shown in FIG. 3 consists of eight pieces 101 to 108, each a combination of eight desired units joined together to form an 8×8 unit square 100. The piece 101 is U-shaped, the horizontal portion comprising a row of four units joined with an additional two unit column at each distal end thereof. The piece 102 is substantially L-shaped comprising a 2×2 unit square connected to one side of a 4-unit column. The piece 103 is a 2×4 unit rectangle. The piece 104 comprises two 2×2 unit squares connected to each other at one corner unit. The piece 105 is a combination of a five-unit column and a three-unit column. The piece 106 is substantially L-shaped comprising a 2×3 unit rectangle connected with a two-unit column. The piece 107 is substantially T-shaped comprising a 2×2 unit square connected with a four-unit column. One side of the 2×2 unit square connected with to the two middle units of the four-unit column. The piece 108 is also T-shaped comprising a 2×3 unit rectangle connected at one edge with a two-units column. Furthermore, each of the above-described pieces consists of only one unit 2. Therefore, the individual units are connected together to form the above-described pieces such that no protuberance 11 remains disposed on any exterior side of any piece.

Figure 8:
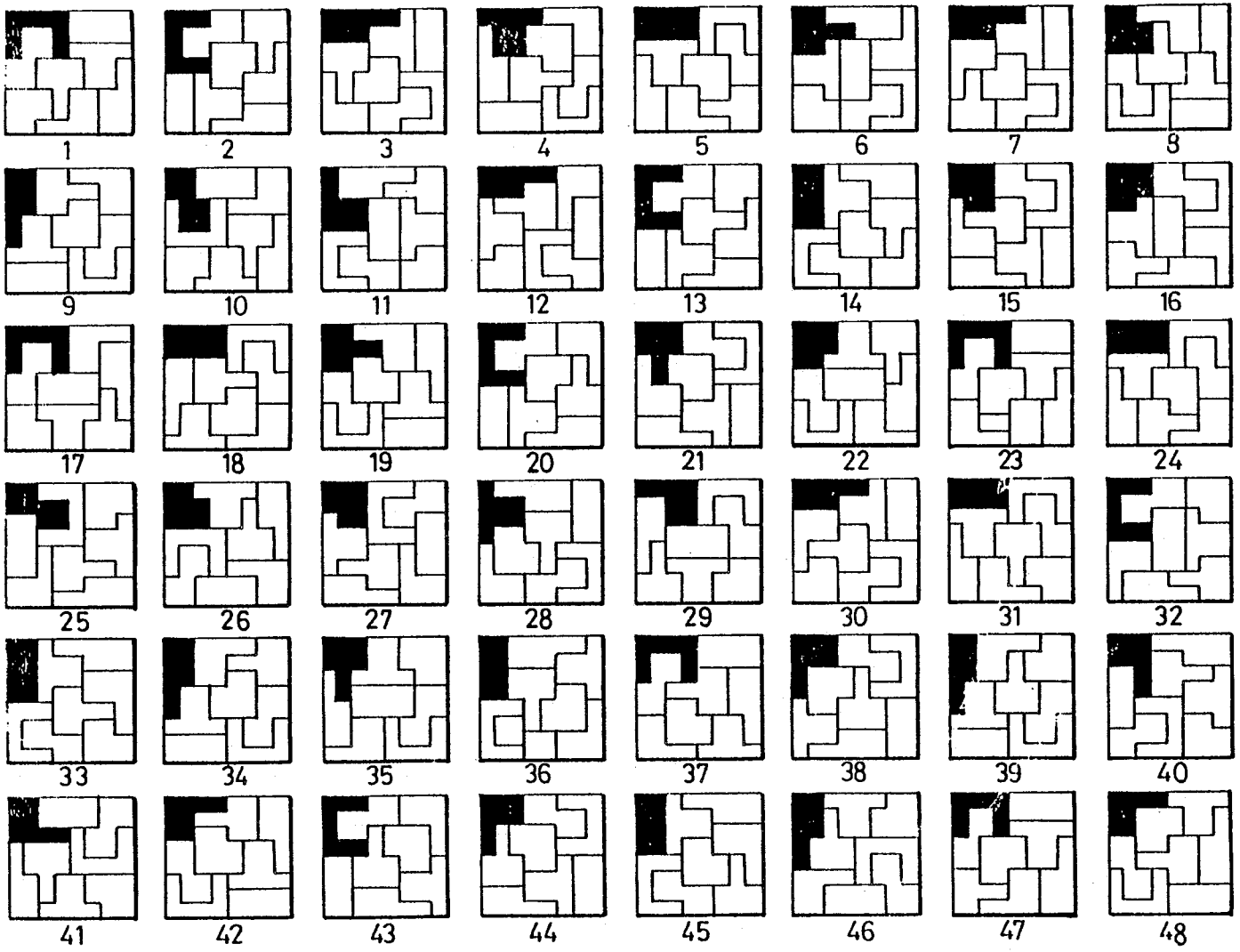
FIG. 8 is an answer key, corresponding to FIG. 3, showing forty-eight different ways to join the eight pieces of FIG. 2 to form an 8×8 square.

As shown in FIG. 3, the eight pieces, 101 to 108, are joinable to form an 8×8 unit square 100. Further, referring to FIG. 8, the answer key presents forty-eight different ways to join the eight pieces together to form an 8×8 unit square. Each configuration is keyed to an initially placed pieced shaded in black.

Figure 4:
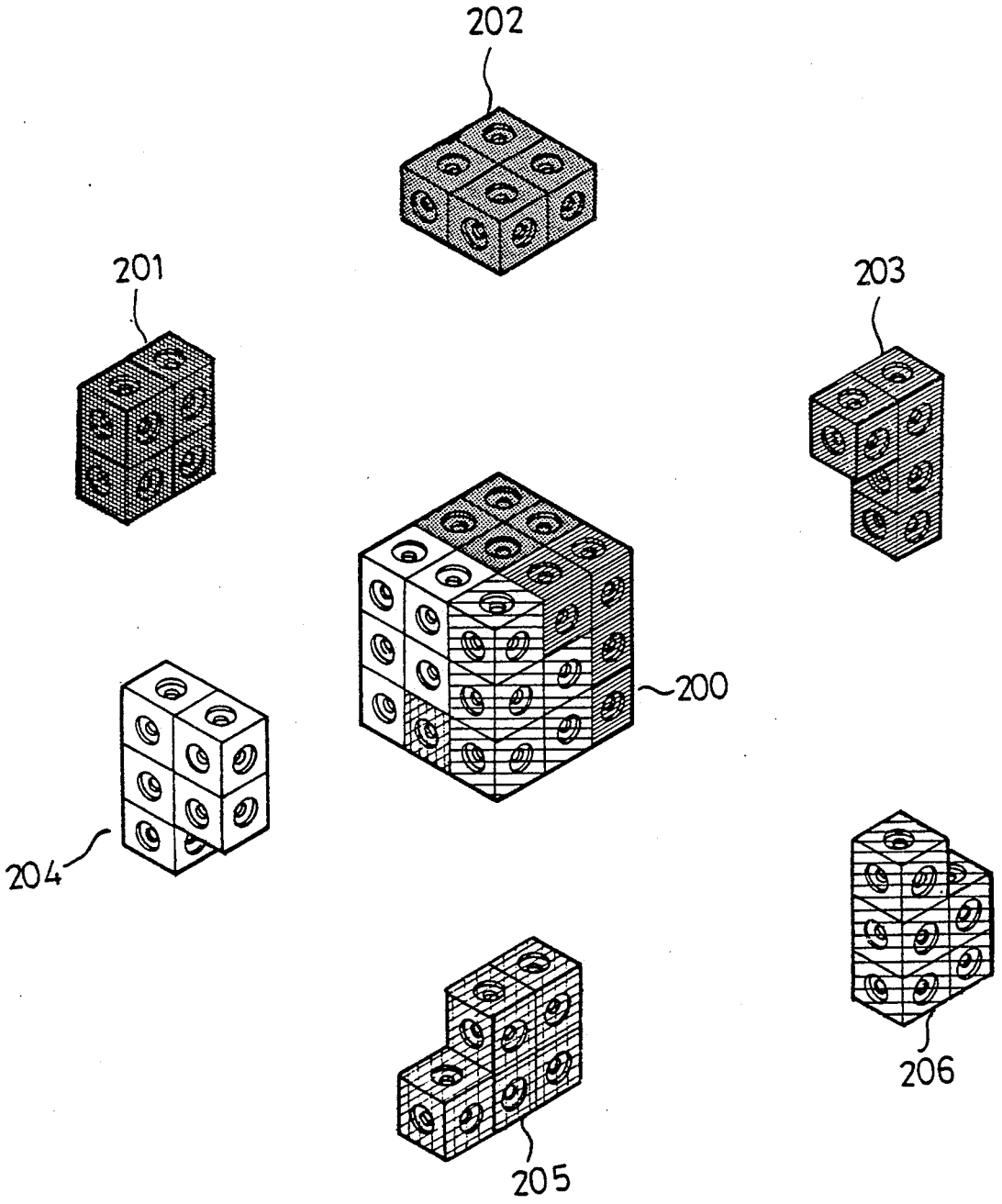
FIG. 4 is a perspective view showing six pieces, each a combination of a number of the two different types of units, joined together to form a 3×3×3 cube.

Another configuration of the combinable toy blocks comprises six pieces, 201 to 206, joined to form a 3×3×3 cube 200, as shown in FIG. 4.

Figure 5:
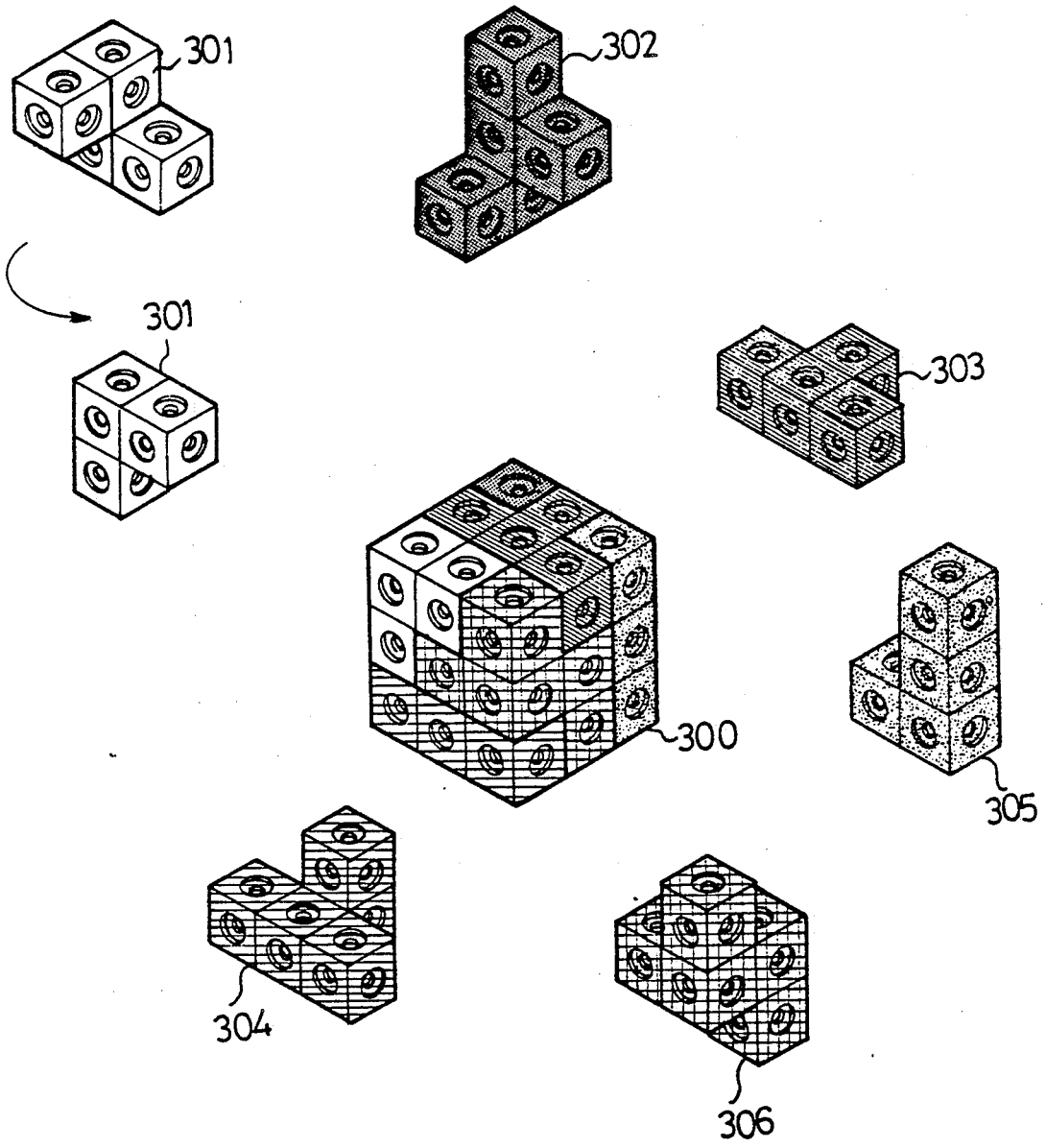
FIG. 5 is a perspective view showing another six pieces, each a combination of a number of the two different types of units, joined together to form another 3×3×3 cube.

A further configuration of the combinable toy blocks comprises a further six pieces, 301 to 306, which are joinable to form a 3×3×3 cube 300, as shown in FIG. 5. Two reference numerals 301, in this figure depict the piece 301 from two different angles.

Figure 6:
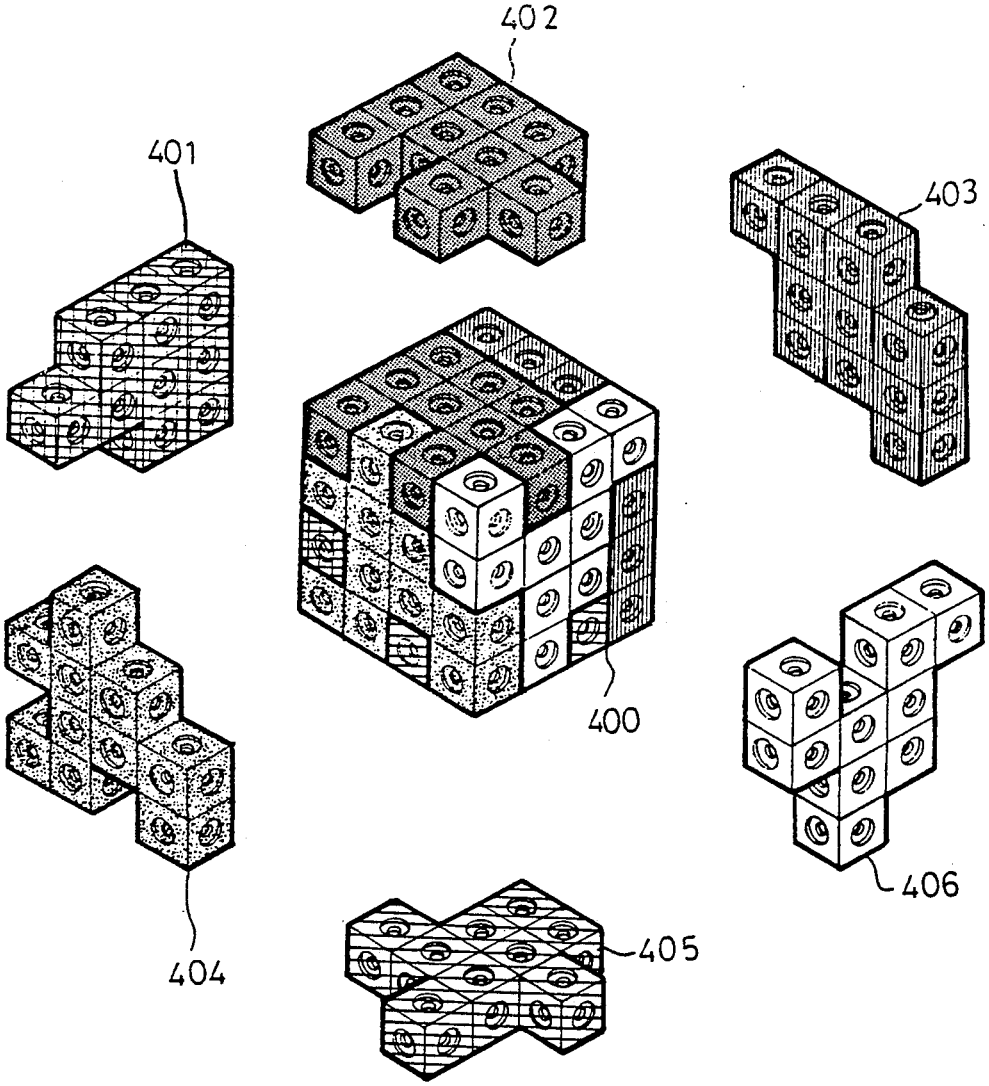
FIG. 6 is a perspective view showing a further six pieces, each combination of a number of the two different types of units, joined together to form a hollow 4×4×4 cube.

A additional configuration of the combinable toy blocks comprises six pieces, 401 to 406, joined to form a 4×4×4 unit hollow cube as shown in FIG. 6.

All the enumerated examples illustrate the variety of exerciser with which the combinable toy blocks are used so as to stimulate creative development.

While the present invention has been explained in relation to its preferred embodiment, it is to be understood that various modifications thereof will be apparent to those skilled in the art upon reading this specification. Therefore, it is to be understood that the invention disclosed herein is intended to cover all such modifications as fall within the scope of the appended claims.

I claim:

1. Combinable toy blocks substantially comprising at most two types of units which are both cubic;

a first unit having a protuberance formed on at least one surface, each protuberance being formed with an enlarged peripheral flange; a depression being formed on each respective remaining surface, each depression having an enlarged peripheral slot formed therein;

a second unit having a depression formed on each surface, each depression having an enlarged peripheral slot formed therein, wherein said flange of said first unit fits into said slot of said second unit, so as to engage said protuberance with said depression; and wherein a plurality of engaging bolts are integrally formed with each surface of said first unit on which said protuberance is located, and each said surface of said first unit and said second unit which is provided with depression has a plurality of openings which are sized and shaped to correspond to said engaging bolts and are adapted to receive said engaging bolts, so as to prevent relative rotation between said first unit and said second unit.

2. Combinable toy blocks as set forth in claim 1, wherein said protuberance is in a shape of a disc.

3. Combinable toy blocks as set forth in claim 1, wherein said protuberance has a square shape.

* * * * *